US006377114B1

(12) United States Patent
Sakurai

(10) Patent No.: US 6,377,114 B1
(45) Date of Patent: Apr. 23, 2002

(54) RESISTOR INDEPENDENT CURRENT GENERATOR WITH MODERATELY POSITIVE TEMPERATURE COEFFICIENT AND METHOD

(75) Inventor: Satoshi Sakurai, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 09/588,418

(22) Filed: Jun. 6, 2000

Related U.S. Application Data

(60) Provisional application No. 60/184,895, filed on Feb. 25, 2000.

(51) Int. Cl.[7] ..... G05F 1/10
(52) U.S. Cl. ..... 327/543
(58) Field of Search ..... 323/315; 327/538, 327/543

(56) References Cited

U.S. PATENT DOCUMENTS 4,450,367 A * 5/1984 Whatley ..... 307/297
4,792,750 A * 12/1988 Yan ..... 323/315
4,890,052 A * 12/1989 Hellums ..... 323/315
4,935,690 A * 6/1990 Yan ..... 323/314
5,144,223 A * 9/1992 Gillingham ..... 323/313
5,432,432 A * 7/1995 Kimura ..... 323/313
5,559,425 A * 9/1996 Allman ..... 323/315
5,619,160 A * 4/1997 Sirito-Olivier et al. ..... 327/530
5,818,292 A * 10/1998 Slemmer ..... 327/539
5,892,388 A * 4/1999 Chiu ..... 327/543

* cited by examiner

*Primary Examiner*—Jeffrey Zweizig
(74) *Attorney, Agent, or Firm*—Girard & Equitz LLP

(57) ABSTRACT

A current generator circuit having an output current with a stable absolute magnitude and which is proportional to a temperature of about $T^{0.5}$ Kelvin. An MOS transistor operating in the linear region produces a drain-source current related to the output current and is biased with a drain-source voltage related to the difference between the base-emitter voltage of a pair of bipolar transistors operating at different current densities. The temperature coefficient of the output current is ideal for biasing an amplifier circuit so as to maintain a minimum settling time over a specified temperature range.

23 Claims, 2 Drawing Sheets

RESISTOR INDEPENDENT CURRENT GENERATOR WITH MODERATELY POSITIVE TEMPERATURE COEFFICIENT AND METHOD

This application claims benefit of provisional application No. 60/184,895, filed Feb. 25, 2000.

BACKGROUND OF THE INVENTION

1. Field of the Invention

The present invention relates generally to current generation circuitry and, in particular, to a current generating circuit which does not rely upon resistors to control the current magnitude and which has a temperature coefficient which is advantageous in many applications.

2. Background Art

Referring to the drawings, FIG. 1 is a schematic diagram of a conventional current generator circuit which utilizes both MOS and bipolar circuit components. Circuit 6 includes a pair of PMOS transistors 10A and 10B connected as a current mirror. Since transistors 10A and 10B are the same size, the drain-source currents for the two transistors are the same. A second pair of cascode-connected NMOS transistors 12A and 12B are connected in series with transistors 10A and 10B, respectively. Transistors 12A and 12B operate to maintain their respective source voltages, VA and VB, at the same level.

PNP transistors 14A and 14B are connected in series with transistors 12A and 12B and thus conduct equal currents. Typically, transistors 14A and 14B are parasitic substrate transistors that are present in many circuits fabricated using conventional MOS processes. Transistor 14B has an emitter area A2 which is larger than the emitter area A1 of transistor so that the base-emitter voltage 14B is smaller than the base-emitter voltage of 14A. The difference in base-emitter voltages ΔVBE is given by the following equation:

$$\Delta VBE=(kT/q)\ \ln\ (A2/A1) \tag{1}$$

where k is Boltzmann's constant, q is electronic charge and T is temperature in Kelvin.

Since ΔVBE is the voltage drop across resistor R, the current flow I through resistor R is as follows:

$$I=[(kT/q)\ \ln\ (A2/A1)]/R \tag{2}$$

The output Iout of current generator 6 is provided by a third PMOS transistor 10C connected to have the same gate-source voltage as transistors 10A and 10B. Iout can be made to differ from I by adjusting the channel width of transistor 10C relative to the channel width of transistors 10A and 10B.

One shortcoming of the FIG. 1 biasing circuit is due to the fact that the value of resistor R, which determines the output current Iout, is not well controlled. In a typical CMOS process, resistor R is made of diffusion or poly silicon. Neither of these materials provides a tight control on the resistor value, which could vary ±30% from the nominal value.

If a circuit being biased by the FIG. 1 current generator circuit requires a certain amount of minimum current, Inom, the current generator must be capable of providing 1.3 (Inom) to ensure that current Inom will be provided where the resistance is 30% larger than the nominal value. At the same time, if the resistance turns out to be 30% less than the nominal value, then the current generator will provide (1.3)(1.3) Inom or 1.7 Inom. This is 70% more current than the current generator was nominally required to provide.

The present invention addresses the above-noted shortcomings of the prior art by providing a current generator circuit with an output current which is more precisely controlled. Thus, unnecessary power consumption is substantially reduced. In addition, as will be explained, the current generator circuit disclosed herein is capable of enhancing the settling time of amplifier circuits which are biased by the circuit. These and other advantages of the present invention will become apparent to those skilled in the art upon a reading of the following Detailed Description of the Invention together with the drawings.

SUMMARY OF THE INVENTION

A current generator circuit which provides an output current having a stable absolute value and a temperature coefficient which, when used to bias an amplifier, provides reduced settling time and optimum power consumption. A first MOS transistor conducts a current related to the output current and is biased to operate in the linear region. A second MOS transistor, having gate and source electrodes which are connected to the gate and source electrodes of the first MOS transistor, is biased for saturation region operation. The second MOS transistor also conducts a current related to the output current and is typically equal to the current of the first MOS transistor.

The current generator circuit preferably further includes a pair of bipolar transistors operating at different current densities to as provide different base-emitter voltages. The bipolar transistors are connected relative to the first MOS transistor so that the drain-source voltage of the first MOS transistor is equal to the difference between the base-emitter voltages. The output current is more stable than that provided by prior art current generator circuits and provides a current which is approximately proportional to $TD^{0.5}$, with T being temperature in degrees Kelvin.

DETAILED DESCRIPTION OF THE INVENTION

In addition to providing improved accuracy of the absolute value of the current, the present invention provides an output current having a temperature dependence which functions to improve the operating characteristics of an amplifier biased by the generator circuit, including amplifiers that are used as a building block to perform signal processing. One of the most important performance specifications for such amplifiers in the settling time Tset.

Figure 2:
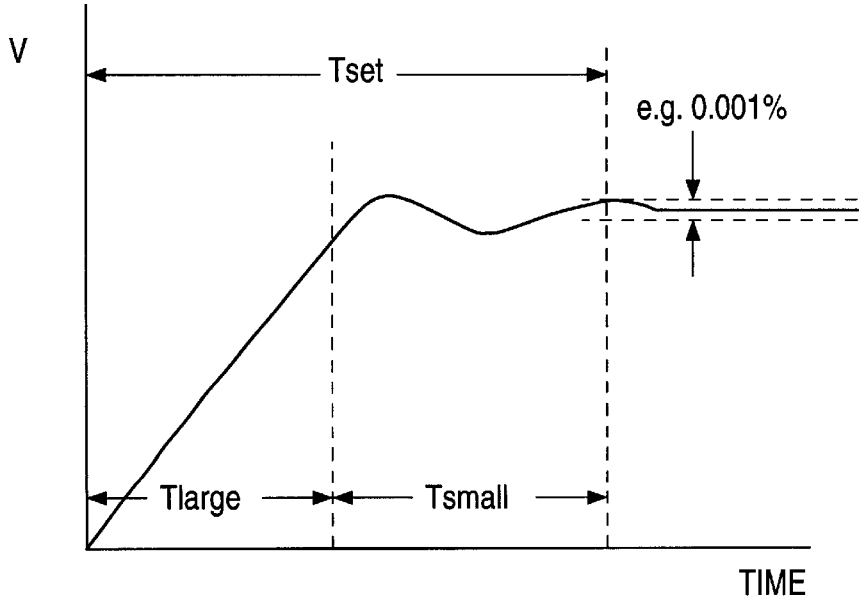
FIG. 2 (PRIOR ART)
FIG. 2 is a graph illustrating the large and small signal settling times of a conventional amplifier.

Referring again to the drawings, FIG. 2 is a graph illustrating an exemplary settling time Tset of a typical amplifier circuit. As can be seen in FIG. 2, the total settling time Tset is the sum of the large signal settling time Tlarge and the small signal settling time Tset. The large signal settling time Tlarge is the amount of time the amplifier spends initially for a large voltage change towards the steady state amplifier output value. The small signal settling time Tsmall is the amount of time spent at the last portions of the settling time after the end of the large signal settling time Tlarge and until the output has, within a predetermined amount such as 0.001%, reached the final steady state value.

When an amplifier is specified to have a certain settling time Tset, the specification must be met over that entire temperature specification for the amplifier. Typically, the amplifier circuit includes a differential input stage which includes a tail current source having a current output Ibias. When the amplifier is biased with a current Ibias, the large signal settling time can be generally expressed as follows:

$$T\text{large } 1/I\text{bias} \quad (3)$$

The small signal settling time Tsmall is related to the transconductance gm of the input MOS transistors of the amplifier circuit as follows:

$$T\text{small } 1/\text{gm} \quad (4)$$

Substituting the equation for the transconductance gm, the small signal settling time Tsmall is as follows:

$$T\text{small } 1/(K\ I\text{bias})^{1/2} \quad (5)$$

where K is defined in equation (6) below.

Transistor constant K is as follows:

$$K=(\mu_s\ Cox\ W)/L \quad (6)$$

where $\mu_s$ is the surface mobility of the majority carriers in the induced channel, Cox is the capacitance per unit area under the gate, W is the transistor channel width and L is the transistor channel length.

It can be seen from equations (3) and (5) that any temperature dependence of Ibias will have a significant effect on the temperature dependence of the total settling time Tset. For example, the temperature dependance of $\mu_s$ is as follows:

$$\mu_s\ T^{-1.5} \quad (7)$$

By substituting equation (7) into equation (6) and substituting the result into equation (5), it can be seen that the small signal settling time Tsmall can be expressed as follows:

$$T\text{small } T^{0.75}/I\text{biaso}^{0.5} \quad (8)$$

Figure 4:
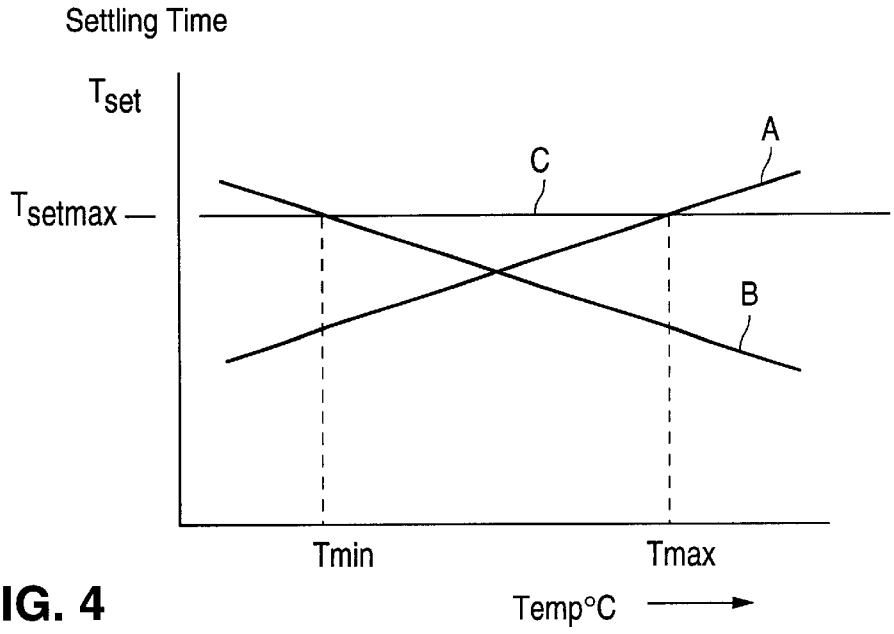
FIG. 4 is a graph illustrating the effect of temperature on the settling time of an amplifier circuit.

FIG. 4 is a graph showing the total settling time Tset of an amplifier versus the temperature T. If the bias current Ibias is made to be independent of temperature, equation (3) shows that the large signal settling time Tlarge will be constant with temperature and the small signal settling time Tsmall will increase as indicated by equation (8). Assuming that Tlarge and Tsmall contributing equally to the total settling time Tset, the total settling time Tset will increase with temperature as indicated by line A of FIG. 4. Assuming that Tsetmax is the specified maximum total settling time that must be meet within a temperature range from Tmin to Tmax, examination of line A in FIG. 4 shows that amplifier will be just at the maximum settling time Tsetmax at temperature Tmax. However, the settling time Tset will be below the Tsetmax at all temperatures lower than Tmax thereby indicating that the amplifier is consuming unnecessary power at these lower temperatures.

On the other hand, if the bias current Ibias is made to be proportional to temperature T, then equations (3) shows that the large signal settling time Tlarge is as follows:

$$T\text{large } 1/T \quad (9)$$

Assuming the same temperature dependency, equation (8) shows that the small signal settling time Tsmall is as follows:

$$T\text{small } T^{0.25} \quad (10)$$

Assuming again that Tlarge and Tsmall contribute equally to the total settling time Tset, the total settling time Tset will decrease with temperature as indicated by line B of FIG. 4. As indicated by FIG. 4, the total settling time Tset will be equal to Tsetmax at the minimum temperature Tmin, but will be better than necessary at higher temperatures thereby indicating that power consumption is being wasted at all temperature above Tmin.

Assuming that Ibias is made to be approximately proportional to $T^{0.5}$, equation (3) indicates that the large signal settling time Tlarge will be as follows:

$$T\text{large } T^{-0.5} \quad (11)$$

Equation (5) indicates that the small signal settling time Tsmall will be as follows:

$$T\text{small } T^{0.5} \quad (12)$$

Assuming again that Tlarge and Tsmall both contribute equally to the total settling time Tset, it is possible to have a total settling time Tset which is independent of temperature as indicated by line C of FIG. 4. Thus, the total settling time Tset can be set at Tsetmax so as to avoid unnecessary power consumption over the specified temperature range.

Figure 1:
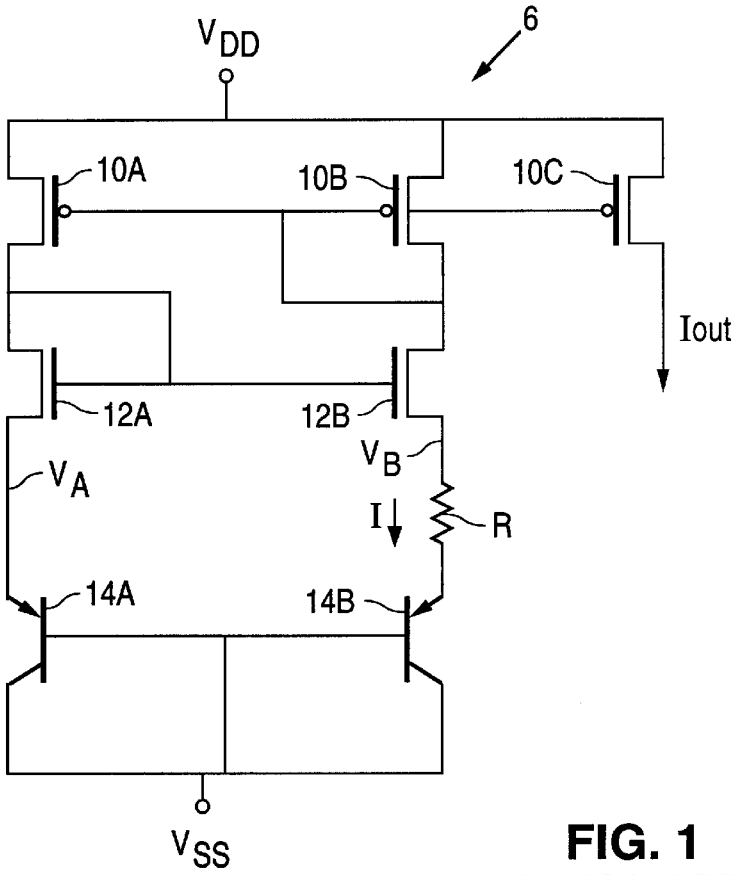
FIG. 1 (PRIOR ART)
FIG. 1 is a schematic diagram of a conventional current generator circuit.
Figure 3:
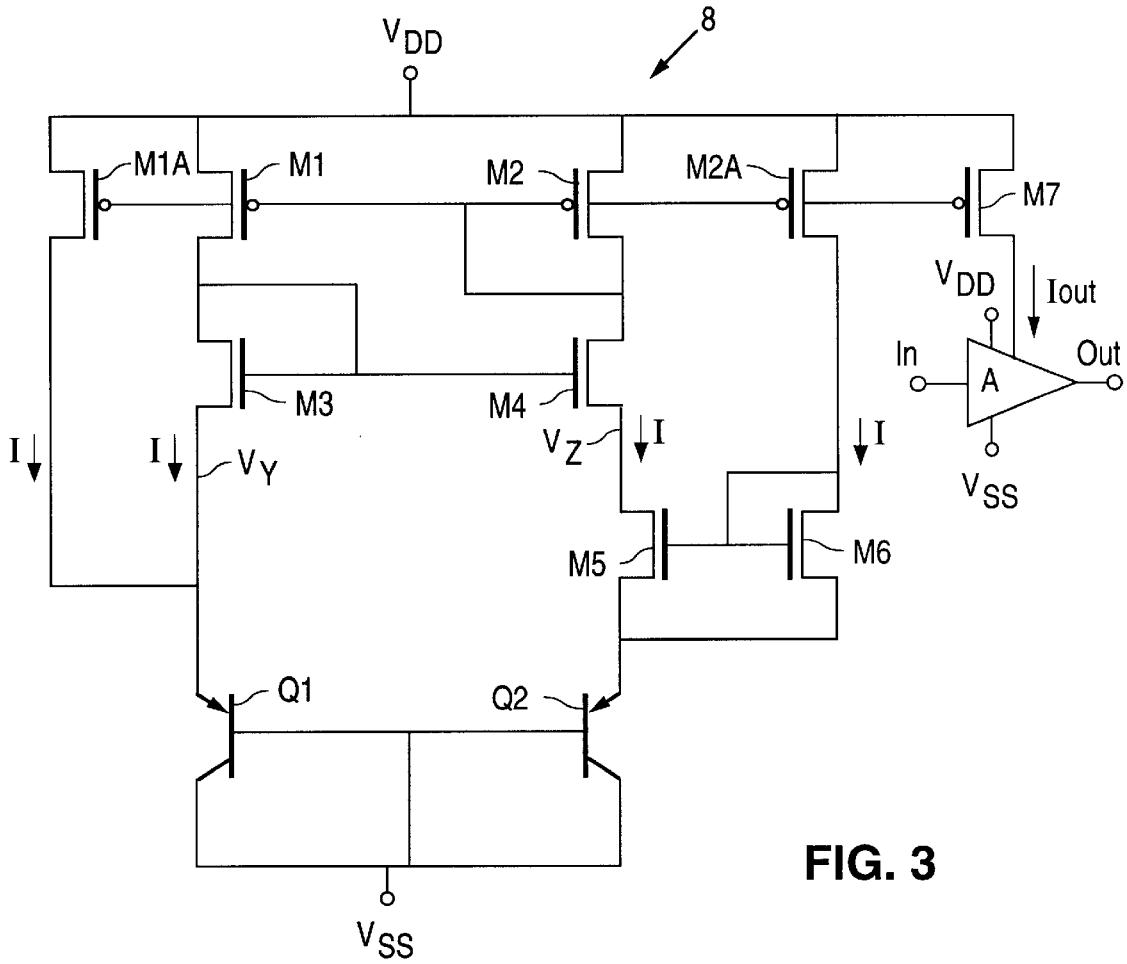
FIG. 3 is a schematic diagram of a current mirror generator circuit in accordance with the present invention, with the current output being used to bias an amplifier circuit.

FIG. 3 is a schematic diagram of a current generator circuit 8 capable of providing an output current Iout which has an absolute magnitude which is well controlled compared to the FIG. 1 current generator circuit. Further, the current magnitude can be made to have a temperature dependency which is proportional to $T^{0.5}$ thereby providing the power consumption advantages indicated by line C of FIG. 4 when used to bias an amplifier circuit, such as amplifier A shown in FIG. 3.

The FIG. 3 circuit includes five PMOS transistors, with transistor M2 forming an input portion of a current mirror circuit and transistors M1A, M1, M2A and M7 forming the output portion of the current mirror. Transistors M1, M2, M1A and M2A are matched to that each transistor conducts the same current I. Matched NMOS transistors M3 and M4 are connected in series with and M1 and M2, respectively. Since the gate voltages of transistors M3 and M4 are the same and since both transistors conduct the same current, the source voltages Vy and Vz of the transistors are equal.

The current I from transistor M3 is combined with current I of transistor M1A so that a parasitic substrate PNP transistor Q1 will conduct a current 2I. Similarly, the current I from transistor M4 is combined with current I from transistor M2A so that parasitic transistor Q2 will also conduct a current 2I. A further NMOS transistor MS is disposed intermediate transistors M4 and Q2 and conducts current I.

Transistor MS is biased to operate in the linear, sometimes referred to as triode, range of operation. This means that the following conditions apply to transistor MS:

$$Vds<(Vgs-Vt) \quad (13)$$

where Vds is the gate-source voltage, Vgs is the gate-source voltage and Vt is the threshold voltage of transistor MS.

The drain-source voltage Vds5 of transistor M5 is forced to be relatively small, equal to the difference in base-emitter voltages of transistors Q1 and Q2. As indicated by equation (2), the drain-source voltage is as follows:

$$Vds\mathbf{5}=(kT/q)\ \ln\ (A\mathbf{2}/A\mathbf{1}) \quad (14)$$

where A1 and A2 are the emitter areas of transistors Q1 and Q2, respectively.

The gate-source voltage Vgs5 of transistor M5 is set by the gate-source voltage Vgs6 of transistor M6 and is relatively large, operation of transistor M5 in the linear region, as defined in equation (13), is assured.

The drain-source current of a transistor operating in the linear region, such as transistor M5, is as follows:

$$Ids5=K5(Vgs5-Vt)Vds5-(K5\ Vds5^2)/2 \quad (15)$$

where K5 is defined in equation (6) and Vt is the transistor threshold voltage.

Transistor M6 is biased for operation in the saturation region of operation where, as contrasted to operation in the linear region defined by equation (13), the drain-source voltage is equal or greater than the difference between the gate-source voltage Vgs the threshold voltage Vt. Operation of transistor M6 in the saturation region is assured since the gate and drain are connected together so that Vds=Vgs.

The drain-source current of a transistor operating in the saturation region, such as transistor M6, is as follows:

$$Ids6=(K6/2)\ (Vgs6-Vt)^2 \quad (16)$$

The characteristics of current I, including the magnitude and temperature characteristics, can then be calculated. Equation (16) is solved for Vgs6, assuming that Ids6 is equal to current I:

$$Vgs6=(2I/K6)^{1/2}+Vt \quad (17)$$

Since the gate-source voltages Vgs5 and Vgs6 are equal, the value of Vgs6 can be substituted into equation (15). Further, the drain-source voltage Vds6 of equation (14) can be substituted into equation (15).

Equation (15) can then be used to solve for current I in terms of the transistor characteristics, with the results as follows:

$$I=2(K5\ Vx^2)/K6 \quad (18)$$

where K5 and K6 are the transistor constants for transistors M5 and M6, respectively, and Vx is (kT/q) ln (A2/A1), with A1 and A2 being the emitter areas of transistors Q1 and Q2, respectively.

Equation (18) is derived by omitting certain second order terms but is a good approximation of the value of I. Breaking K5 and K6 down in terms of channel width, channel length and the like, equation (18) can be written as follows:

$$I=2(W5/W6)\ (W5/L)\mu_s CoxVx^2 \quad (19)$$

where W5 and W6 are the channel widths of transistors M5 and M6, respectively and L is the channel length for transistors M5 and M6.

The performance of current generator circuit 8 of FIG. 4 was measured using simulation, assuming a typical process, a fast process and a slow process. Even under these extreme conditions, the variation in the magnitude of current I at a given temperature is less than ±8%. A substantial improvement over the prior art circuit of FIG. 1.

Addressing the temperature characteristics of current I as defined by equation (19), $\mu_s$ is proportional to $T^{-1.5}$ as shown by equation (7). The temperature characteristics of Vx are as follows:

$$Vx^2\ T^2 \quad (20)$$

Thus, referring back to equation (19), the temperature characteristics of current I are as follows:

$$I\ T^{0.5} \quad (21)$$

Simulation of an exemplary implementation of circuit 8 of FIG. 3 indicated that the current was actually proportional to $T^{0.4}$ instead of the theoretical $T^{0.5}$ indicated by equation (21). However, this difference results in a difference in output current I of only a few percent at the temperature extremes when normalized at room temperature.

Thus, a novel current generator circuit has been disclosed which does not utilize process dependent resistors. Moreover, the output current is approximately proportional to the square root of temperature, a temperature dependence which can be utilized to meet the settling time requirement of an amplifier while optimizing the power consumption. While the current generator circuit has been disclosed in some detail, it is to be understood that certain changed can be made by those skilled in the art without departing from the spirit and scope of the invention as defined by the appended claims. By way of example, it is possible to achieve the desired temperature dependence by altering the relative current densities of transistors 14A and 14B by way of current levels rather emitter areas.

What is claimed is:

1. A current generator circuit comprising:

a first MOS transistor;

bias circuitry configured to bias the first MOS transistor so that the first transistor operates in a linear region of operation, with the bias circuitry including a second MOS transistor which operates in a saturation region of operation and which has a gate and a source coupled to a gate and a source of the first MOS transistor, respectively; and output circuitry coupled to the first MOS transistor configured to provide an output current related to a drain-source current of the first MOS transistor.

2. The current generator circuit of claim 1 wherein the bias circuitry operates to set a drain-source voltage of the first MOS transistor to a value relatively independent of the drain-source current of the first MOS transistor.

3. The current generator circuit of claim 1 wherein the bias circuitry includes first and second bipolar transistors and wherein the drain-source voltage of the first MOS transistor is related to a difference in base-emitter voltages of the first and second bipolar transistors.

4. The current generator circuit of claim 3 wherein the bias circuitry operates to bias the first MOS transistor so that drain-source current is approximately proportional to a temperature of $T^{0.5}$ where T is temperature in Kelvin.

5. The current generator circuit of claim 1 wherein the second MOS transistor conducts a drain-source current related to the output current.

6. The current generator circuit of claim 5 wherein the bias circuitry includes first and second bipolar transistors connected relative to the first MOS transistor so that a drain-source voltage of the first MOS transistor is related to a difference in base-emitter voltages of the first and second bipolar transistors.

7. The current generator circuit of claim 6 wherein a total current through the first and second MOS transistors is equal to a current through the first bipolar transistor.

8. The current generator circuit of claim 7 wherein an emitter area of the first bipolar transistor is larger than a emitter area of the second bipolar transistor.

9. A current generator circuit comprising:

a first MOS transistor which conducts a drain-source current related to an output current of the current generator circuit;

a second MOS transistor which conducts a drain-source current related to the output current, with a gate and a source of the second MOS transistor being coupled to a gate and a source, respectively, of the first MOS transistor;

first and second bipolar transistors biased to operate at different current densities, with the first and second bipolar transistors being connected relative to the first MOS transistor such that a drain-source voltage of the first MOS transistor is equal to a difference in base-emitter voltages of the first and second bipolar transistors; and output circuitry coupled to the first MOS transistor and configured to provide the output current which is related to the drain source current of the first MOS transistor.

10. The current generator circuit of claim 9 wherein the second MOS transistor is biased in the saturation region of operation.

11. The current generator circuit of claim 10 wherein the first and second MOS transistors are NMOS transistors and the first and second bipolar transistors are PNP transistors.

12. The current generator circuit of claim 10 wherein the drain-source currents of the first and second MOS transistor are equal and wherein the first bipolar transistor is connected relative to the first and second MOS transistors such that current flow through the first bipolar transistor is equal to a sum of the first and second MOS transistor drain-source currents.

13. A current generator circuit comprising:

a first MOS transistor which conducts a first current which is related to an output current of the current generator circuit;

a second MOS transistor having a gate and source connected to a gate and a source, respectively, of the first MOS transistor;

bias circuitry configured to bias the first and second MOS transistors in a linear and saturation region, respectively; and output circuitry configured to provide the output current.

14. The current generator circuit of claim 13 wherein the bias circuitry operates to bias a drain-source voltage of the first MOS to a value which is relatively independent of the first current.

15. The current generator circuit of claim 14 wherein the bias circuitry includes first and second bipolar transistors and wherein the drain-source voltage of the first MOS is a difference between a base-emitter voltage of the first and second bipolar transistors.

16. The current generator circuit of claim 15 wherein the output circuitry includes a current mirror having an third MOS transistor which conducts the first current and a fourth transistor which conducts the output current.

17. The current generator circuit of claim 15 wherein the output circuitry includes a current mirror having an third MOS transistor which conducts the first current and a fourth transistor which conducts a current which flows through the second MOS transistor.

18. The current generator of claim 13 wherein the first current is approximately proportional to a temperature of $T^{0.5}$ where T is temperature in Kelvin.

19. A method of generating an output current comprising:

providing first and second MOS transistors and first and second bipolar transistors;

applying a drain-source voltage to the first MOS transistor equal to a difference between base-emitter voltages of the first and second bipolar transistor;

biasing the second MOS transistor for operation in the saturation region;

applying a gate-source voltage of the second MOS transistor to a gate and source of the first MOS transistor; and deriving the output current from a drain-source current of the first MOS transistor.

20. The method of claim 19 further including connecting the first bipolar transistor and the first and second MOS transistors so that the first bipolar current is equal to a sum of the drain-source current of the first MOS transistor and a drain-source current of the second MOS transistor.

21. A method of biasing an amplifier circuit comprising:

providing first and second MOS transistors;

applying a gate-source voltage of the second MOS transistor to a gate and source of the first MOS transistor;

deriving a bias current having a magnitude which is approximately proportional to a temperature of $T^{0.5}$, where T is temperature in Kelvin, from a drain-source current in the first MOS transistor; and biasing the amplifier circuit with the bias current.

22. The method of claim 21 wherein the deriving a bias current includes operating the second MOS transistor in a saturation region of operation.

23. The method of claim 22 where the operating includes:

providing first and second bipolar transistors; and applying a voltage equal to a difference in a sum of base-emitter voltages of the first and second bipolar transistors.

* * * * *